United States Patent [19]

Poulsen et al.

[11] 4,097,048

[45] Jun. 27, 1978

[54] SLOT MACHINE

[75] Inventors: Freddy Poulsen, Höjbjerg; Robert Edvin Poulsen, Hinnerup, both of Denmark

[73] Assignee: Bell-Matic A/S, Denmark

[21] Appl. No.: 652,785

[22] Filed: Jan. 27, 1976

[51] Int. Cl.[2] ..... A63F 5/04

[52] U.S. Cl. ..... 273/143 R

[58] Field of Search ..... 273/143 R, 143 A, 143 B, 273/143 C, 143 D, 143 E, 138 R, 138 A, 142 H, 142 HA, 1 R, 1 E

[56] References Cited

U.S. PATENT DOCUMENTS

| | | | |
|---|---|---|---|
| 2,044,320 | 6/1936 | Norris | 273/143 R |
| 2,180,029 | 11/1939 | Babcock | 273/143 E |
| 3,011,790 | 12/1961 | Brunson | 273/143 R |
| 3,464,693 | 9/1969 | Bailey | 273/143 R X |
| 3,759,525 | 9/1973 | Davis | 273/143 R |

FOREIGN PATENT DOCUMENTS

| | | | |
|---|---|---|---|
| 1,238,486 | 7/1971 | United Kingdom | 273/143 R |

*Primary Examiner*—Richard C. Pinkham

*Assistant Examiner*—Arnold W. Kramer

*Attorney, Agent, or Firm*—Craig & Antonelli

[57] ABSTRACT

A slot machine of the type having a number of drums mounted individually rotatably on a common shaft and each provided with an annular row of various signs or symbols on the outer drum surface thereof, a starting arrangement is provided for starting the drums to rotate with a further device being provided for thereafter stopping the drums; a detector construction detects the stop positions of the drums and actuates a winner indicator in response to detection of the drums having stopped in a specific winner combination of the stop positions; each drum is mounted on the shaft by a free-wheeling coupling and the starting arrangement for the drums includes a device for rapidly rotating the shaft at least a fraction of a revolution, whereby the drums are rotated correspondingly, but allowed to rotate freely on the shaft after stoppage of the shaft. Preferably the free-wheeling coupling is made as an overrunning clutch which may be actuated or deactuated so as to enable a selected drum to remain standing still when the other drums are started, thus enabling "holding" of a drum in an easy manner.

9 Claims, 9 Drawing Figures

SLOT MACHINE

Figure 1:
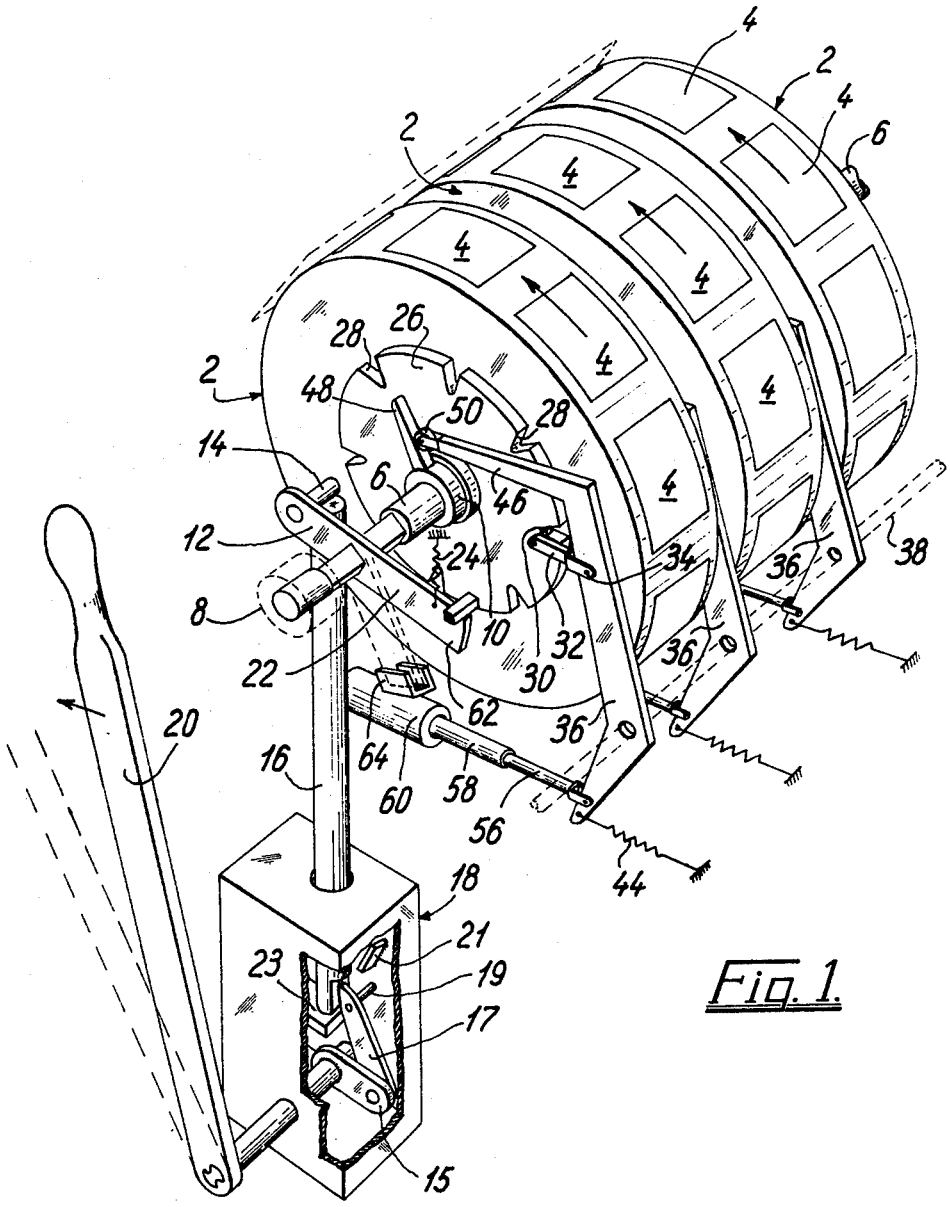

The present invention relates to slot machines of the type having a number of rotary drums mounted on a common shaft so as to be individually rotatable thereabout with each drum being provided with an annular row of various signs or symbols, means for starting the rotation of the drums in response to actuation of a starting mechanism connected with an actuator handle, means operable to automatically stop the respective drums preferably at mutually different moments of time after the start of the drums, means for detecting the stop positions of the respective drums, and means for actuating a pay mechanism or other "winner indication means" in response to the drums stopping in positions corresponding to a specific winner combination of said stop positions as defined by a specific combination of said signs or symbols being shown in a window in the wall of the slot machine. A machine of this type is disclosed in our copending patent application Ser. No. 510,993, filed Oct. 1, 1974.

It is an object of the invention to provide a slot machine of this type in which the means for starting the drums are of improved design relative to the slot machines of the prior art in which it has been customary to cause the drums to start by actuation of impact means acting on one of a number of bosses mounted in an annular row adjacent the periphery of the drum. The prior art arrangements have been rather complicated and are not constructed so that it is possible for a user to hold or arrest one drum while starting the other drums.

According to the present invention there is provided a slot machine of the type referred to in which the common shaft of the drums is mounted so as to be rotatable through at least a fraction of one revolution with the means for starting the drums being constituted by means for causing the shaft to rotate rapidly during a short interval of time, from an initial position to a stop position thereof, each of the drums being connected with the shaft through a one-way rotation clutch adapted so as to cause the drums to be rotated by the start rotation of the shaft and to allow the drum to continue its rotation upon the start rotation of the shaft being stopped. Thus for starting the drums it is sufficient to cause the shaft to carry out a fast, limited rotation, whereafter the drums may rotate freely until the stop means are actuated.

The starter system according to the invention is easy to adapt so as to provide for the possibility of holding or arresting one drum while starting the others, since it is sufficient to make use of a one-way rotation clutch of the type having actuator means operable to make the clutch inoperative, whereby these actuator means may be operated during the start rotation of the shaft for preventing the shaft from starting the selected drum while it starts the other drums.

Figures 2, 3:
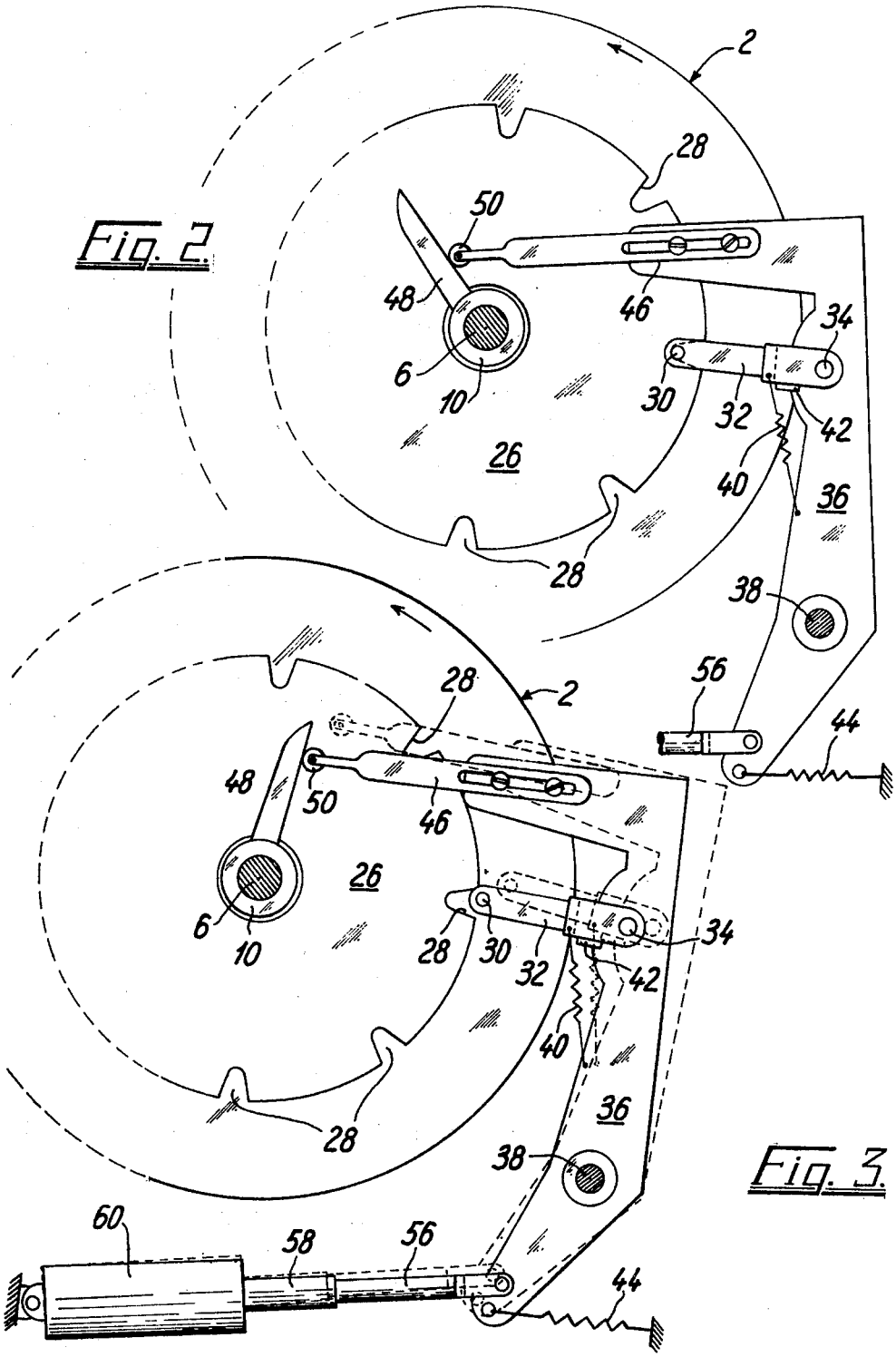
Figure 4:
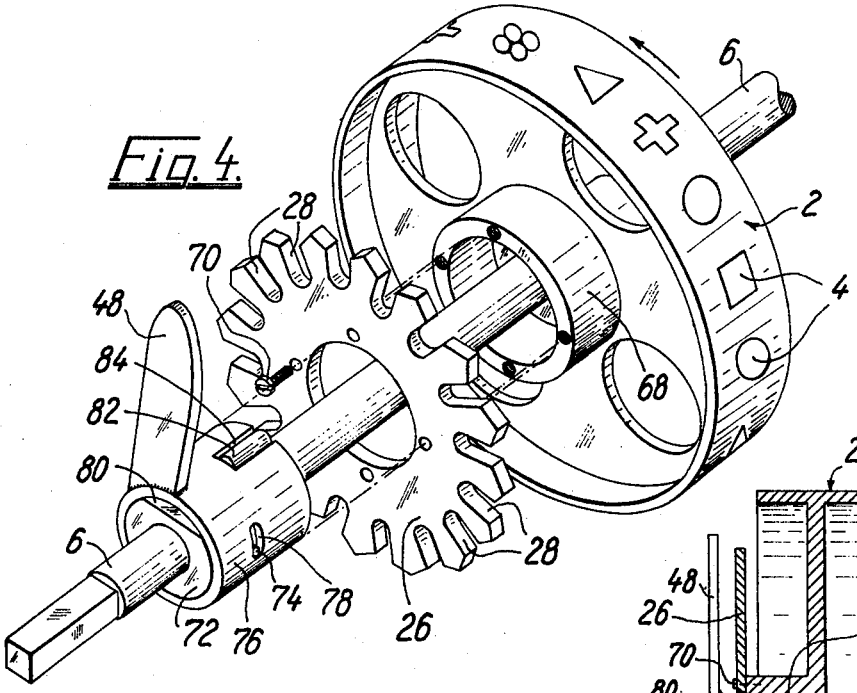
Figure 5:
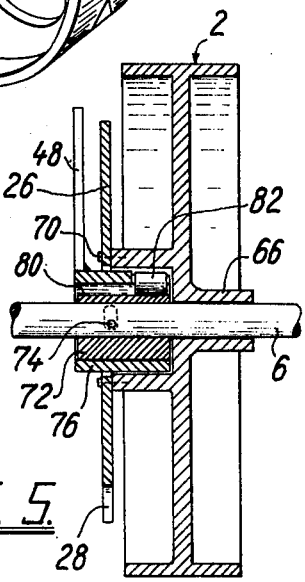
Figure 6:
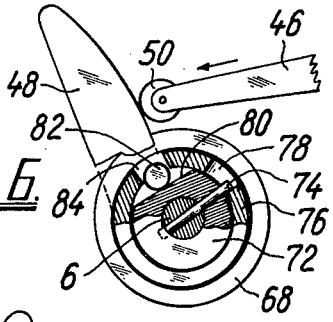
Figure 7:
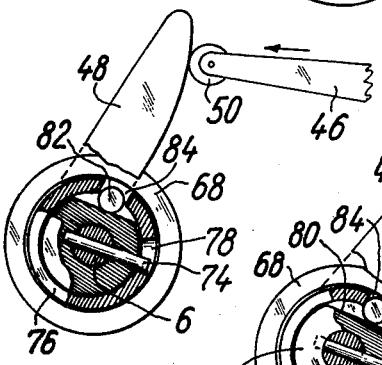
Figure 8:
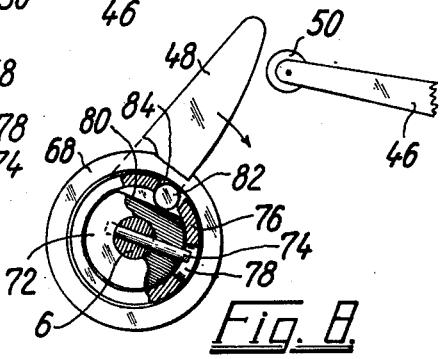
Figure 9:
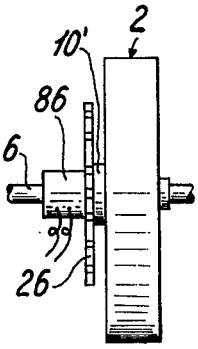

These and other features and advantages of the present invention will be described in more detail in the following, by way of examples, reference being made to the accompanying drawing, in which:

FIG. 1 is a schematic perspective view of the drum section of a slot machine according to the invention, FIGS. 2 and 3 are end views of a drum and its associated control means, shown in the initial position of the starter means and an intermediate ready-to-start-position, respectively, FIG. 4 is an exploded perspective view of a preferred embodiment of the drum and the one-way rotation clutch, FIG. 5 is a sectional view thereof, FIGS. 6-8 are end views, partly in section, showing the clutch in three different positions, and FIG. 9 is a schematic view of a modified embodiment of the start and hold system.

The drum section shown in FIG. 1 comprises three drums generally designated by the reference numeral 2 having symbols 4 printed or otherwise provided on their outer cylindrical surface. The drums 2 are mounted on a common shaft 6 which is journalled in end bearings 8 in an apparatus chassis (not shown). In the hub portion of each drum 2 is mounted a free-wheeling unit or one-way clutch 10 of the type principally known from bicycle wheels and serving to make the shaft 6 engage the drum 2 by counterclockwise rotation of the shaft, while allowing the drum to rotate freely in counterclockwise direction relatively to the shaft 6.

At one end of the shaft 6 is provided a rigid radial arm 12 having a pin 14 located just above the top end of an actuator rod 16 which projects upwardly from an actuator unit 18 connected with the actuator handle 20 of the slot machine. The unit 18 is adapted so as to cause the rod 16 to be gradually displaced upwardly when the handle 20 is pulled, and to release the rod 16 when the handle 20 comes to its extreme actuating position, whereby the rod 16 is allowed to be rapidly downwardly displaced. The rod moving mechanism of the unit 18 may be designed in any convenient manner, and it is shown as an illustrative example only that it may comprise a radial arm 15 mounted on the handle shaft and at its outer end pivotally supporting a pawl member 17, the top end of which engages a shoulder portion of the rod 16 so as to be able to force the rod 16 upwardly when the handle shaft is rotated counterclockwise. In a top position of the pawl member 17 a tappet 19 thereon engages an inclined rigid cam surface 21 which by the last part of the handle pulling movement urges the pawl member 17 out of engagement with the shoulder portion of the rod 16, whereby the rod 16 is released for carrying out its rapid downstroke, which is stopped by a rigid stop member 12. When the handle 20 is returned to its initial position the pawl member 17 will again engage the shoulder portion of the rod 16 so as to be ready for the next start of the drums.

By its upstroke the rod 16 engages the pin 14 and causes the radial arm 12 to rotate the shaft 6 clockwise. The radial arm 12 or another radial arm 22 associated therewith is biased by means of a spring 24 in a counterclockwise direction, and of course the spring 24 will be stretched as the rod 16 is moved upwardly, the shaft 6 now rotating without rotating the drums 2 When the rod 16 is allowed to move down, at the end of the pulling of the handle 20, the spring 24 causes the shaft 6 to rotate rapidly in the counterclockwise direction, whereby the drums will be rotated together with the shaft 6 and, due to the free-wheeling units 10, the drums will continue their rotation when the shaft 6 is stopped by the rod 16 coming to its bottom position against the rigid stop member 23. Thereafter, the drums 2 may be allowed to rotate during a time period and then stopped according to any suitable stopping method, preferably by means of a stop pawl member being moved abruptly against a drum portion having an annular row of notches, whereby the pawl member will engage one of these notches and stop the drum in a well defined position. A stop arrangement of this type is described in the following combination with a special "holding" system.

In a preferred embodiment illustrated in FIG. 1 and other figures of the drawing, the free-wheeling units 10 are used additionally for enabling the drums 2 to be individually "held" in a simple manner. "Holding" of a drum 2 means that the player wants to maintain the position of the drum 2 during the next operation of the machine, and for obtaining this he actuates a button (not shown) associated with the selected drum 2 before he pulls the handle 20. The means for holding the drums 2 are combined with the means for stopping the drums 2 in the manner described more fully hereinbelow.

Each drum 2 is provided with a concentric disc portion 26 in the periphery of which there is provided a row of notches 28, each corresponding to one of the symbols 4 on the associated drum 2. In a position of rest of the respective drum 2 one of the notches 28 is engaged by a cross pin or stop pawl member 30 on the free end of a pawl lever 32, the other end of which is pivotally secured, at 34, to another lever 36 which is pivotally secured to a rigid, transverse shaft 38 mounted in the chassis outside the periphery of the drums 2. The lever 32 is biased downwardly by a spring 40 (FIGS. 2 and 3), but it is rested against a stop 42 (FIGS. 2 and 3) so as to assume a well defined position in which the lever 32 holds the associated drum 2 in a correspondingly well defined position. The lever 36 is biased counterclockwise by means of a spring 44, and hereby the cross pin 30 rests against the bottom of the notch 28.

The upper end of each lever 36 has an extension 46 projecting generally inwardly towards the shaft 6 or rather towards a radial arm 48 projecting from the free-wheeling unit 10. The exterior end of the lever portion 46 is provided with a roller 50 bearing against the front edge of the radial arm 48.

The lower end of each lever 36 is connected with a pulling rod 56 associated with the rod yoke 58 of a "suction magnet" or solenoid 60 in such a manner that the lower end of the lever 36, against the action of the spring 44, is moved towards the left when the solenoid 60 is energized.

The free-wheeling unit 10 is constructed as an overrunning clutch with the radial arm 48 functioning as clutch actuator arm. The arm 48 is operable to shift the clutch between free-wheeling in one direction only and free-wheeling in both directions. When the radial clutch actuator arm 48 is swung or biased counterclockwise relatively to the shaft 6 it causes the shaft 6 to be out of driving engagement with the associated drum 2, while, when not so biased, it causes the associated drum 2 to be in driving engagement with the shaft 6. Therefore, when the handle 20 is pulled the shaft 6 and the clutch arm 48 will be rotated clockwise without rotating the drum 2, whereby the roller 50 and therewith the entire upper portion of the lever 36 will be swung towards the right about the shaft 38, against the action of the lower spring 44.

Immediately before the release position of the handle 20 is reached, the stop pin 30 will be retracted from the notch 28 so as to be situated in the outermost end of the notch.

On the shaft 6, preferably in connection with the radial arms 12 and 22, is mounted a plate member 61 which, by the actuation of the handle 20 is swung clockwise towards a photoelectric or other position detecting member or switch 64 which — directly or indirectly — detects the handle 20 being pulled to immediately adjacent its release position. The detector member 64, when actuated, produces an actuation signal which causes the solenoid 60 to be energized, whereby the pulling rod 56 is pulled towards the left so as to cause the lever 36 to be swung further clockwise about the shaft 38. The cross pin or pawl member 30 leaves the notch 28 entirely, and the roller 50 leaves the actuator arm 48 of the overrunning clutch When immediately thereafter the actuator rod 16 is allowed to move down the spring 24 will cause the shaft 6 to rotate counterclockwise, and, since the pin 30 is out of engagement with the notch 28 and the clutch actuator arm 48 is now non-biased counterclockwise so as to actuate the clutch, the rotating shaft 6 will cause the drum 2 to be rotated counterclockwise, as described hereinabove. A control unit (not shown) serves to deenergize the solenoid 60 a certain time after the start of the drum, whereby the spring 44 causes the lever 36 to swing counterclockwise so as to make the cross pin or stop pawl member 30 enter one of the notches 28 and thus stop the drum in that particular position.

Now, if it is desired to "hold" one particular drum while not holding the others, the operator actuates a switch (not shown) serving to simply prevent energization of the solenoid 60. Therefore, when the position detector member or switches 64 cause the other solenoids to be energized and to swing their respective levers 36 out of engagement with the notches 28 and the clutch actuator arms 48 the lever 36 of the held drum 2 in question will remain engaging the notch 28 and the clutch actuator arm 48. Due to this continued engagement the held drum 2 will be unable to rotate while allowing the shaft 6 to rotate, and, when the shaft 6 thereafter rotates for starting the other drums 2 the selected drum, 2 will be "held" during the new operation cycle of the machine. When the shaft 6 carries out its rapid counterclockwise rotation, the clutch actuator arm 48 also will be rotated, but due to the spring 44, the lever 36 will follow this movement by swinging inwardly and thus maintain its pressure on the clutch actuator arm 48, this being the condition for the clutch to be rotated without drivingly engaging the "held" drum 2.

FIGS. 4–8 show in more detail a preferred arrangement of a drum 2 and associated overrunning clutch with the drum 2 having at one side a hub portion 66 rotatably received on the shaft 6, and at its other side a cylindrical flange portion 68 encircling the clutch 10. The disc member 26 with the peripheral notches 28 is secured to the outer end of the flange portion 68 by means of screws 70.

The clutch 10 comprises an innermost bushing portion 72 rigidly secured to the shaft 6 by means of a cross pin 74 and a surrounding sleeve portion 76 provided with the clutch actuator arm 48 and held to the inner bushing 72 by means of the pin 74 projecting outwardly into a circumferentially extending recess 78 in the sleeve 76, whereby the sleeve 76 is rotatable relative to the bushing 72 to a limited extent defined by the extension of the recess 78. The bushing 72 generally fills out the sleeve 76, but at one place its generally cylindrical surface is cut off to form a planar facet 80. On this facet is rested a freely movable roller 82 the sides of which are received between the walls of a recess 84 in the sleeve 76. The diameter of the roller 82 is so selected that when it rests on the middle portion of the facet 80, nearest the shaft 6, it does not engage the inner surface of the drum flange portion 68 while it engages this surface when it is rested adjacent one end of the facet 80.

The position shown in FIG. 6 is the initial position in which the clutch actuator arm 48 is held towards the left both by the gravity and by the resilient pressure from the roller 50, the lower end of the recess 78 engaging the cross pin 74 to prevent rotation of the sleeve 76 and in this position the clutch roller 82 is out of engagement with the drum flange 68. When the shaft 6 is rotated clockwise by the handle 20 being pulled, the cross pin 74 causes both the bushing 72 and the sleeve 76 to participate in this rotation towards the position shown in FIG. 7, whereby the roller 50 is forced rearwardly by the clutch actuator arm 48. Now gravity seeks to turn the radial arm 48 further clockwise, but the arm 48 is still held towards the left by the pressure from the roller 50. As described, during the very last part of the handle pulling operation the solenoid 60 is actuated so as to cause the roller 50 to move further back, whereby the clutch actuator arm 48 as shown in FIG. 8 is allowed to move by gravity further clockwise relative to the bushing 72. This causes the sleeve 76 to rotate so as to bring the clutch roller 82 towards the right hand side of the facet 80, whereby the roller is displaced outwardly so as to engage the inside of the drum flange 68. Even thereafter the entire assembly of the shaft 6, bushing 72, sleeve 76 and clutch actuator arm 48 may be rotated further clockwise without rotating the associated drum 2, because the roller 82 would then tend to roll outwardly of the wedge shaped space between the facet 80 and the surface portion of the flange 68 engaged by the roller 82.

When thereafter the shaft 6 is brought to rotate rapidly in counterclockwise direction the clutch roller 82 is wedged into the wedge-shaped space so as to lock the parts together and cause both the sleeve 76 and the drum flange 68 and therewith the entire drum 2 to rotate together with the shaft 6 back to the position shown in FIG. 6. When the shaft 6 and the clutch parts stop in this position nothing will prevent the drum 2 from continuing its counterclockwise rotation, since the drum flange 68 now seeks to move the clutch roller 82 outwardly of the wedge shaped space.

If the "hold" button or the switch is actuated the roller 50 will not be retracted from the clutch actuator arm 48 at the end of the handle pulling operation, i.e., the actual rapid start position will not be as shown in FIG. 8, but as shown in FIG. 7. In this position the clutch arm 48 is held by the roller 50 so as to make the clutch inoperative, and when the shaft 6 is rotated rapidly counterclockwise it will not, therefore, impart any start rotation to the associated drum 2, which is moreover locked against rotation by the cross pin or stop pawl member 30 engaging one of the notches 28 in the drum disc portion 26. In order to maintain the clutch inoperative during the rapid rotation of the shaft 6 it is necessary to ensure that the corotating clutch arm 48 is steadily biased towards the left during the fast swinging thereof, but this is achieved automatically by virtue of the lever 36 with the roller 50 being biased by the spring 44 in such a manner that the freely swingable lever 36 is able to follow the clutch actuator arm 48 and urge it counterclockwise ahead of the counterclockwise rotation of the bushing 72.

The stop position shown in FIG. 6 may be reached either immediately after start, if the drum has been "held," or after normal operation, when a rotating drum 2 is stopped by the associated lever 36 being released from its solenoid 60 so as to swing inwardly by the action of the spring 44, and make its cross pin or stop pawl member 30 engage with one of the notches 28 of the drum 2. In the stop position the roller 50 assumes the position shown in FIG. 6, ready for repeated operation.

It will be understood that the invention is in no way limited to the embodiment shown and described. The "holding" arrangement, if used at all, may be modified to a large degree; its main principle is that it comprises means for maintaining the free-wheeling clutch inoperative during the start period of the other drums 2. The invention is not limited to any specific kind of free-wheeling clutch nor to any specific manner of releasing the coupling in the "holding" situation. Thus, it would be possible to use an overrunning clutch having electromagnetically operable means for releasing the clutch, whereby for effecting the holding of a drum 2 it would be sufficient to make use of the manual "holding" button as a switch for the release means of the clutch. As an example FIG. 9 illustrates an arrangement comprising a solenoid 86 mounted in association with the overrunning clutch 10′ so as to be operable to effect axial displacement of a clutch actuator or deactuator (not shown) in order to selectively switch the clutch for effecting start or non-start (holding) of the drum according to the requirements. The shaft 6 should not necessarily be rotated against the start direction preparatory to the starting of the drums if the clutch actuating or deactuating means are arranged so as to be independent of the rotation of the shaft and if also the drum stop means are arranged so as to be retractable from the drums independently of rotation of the drum shaft.

In the foregoing nothing has been described concerning the means for detecting the stop positions and actuating the winner indicator means. It will be appreciated, however, that these various means are or may be independent of the features to which the invention relates, and since they are well known in the art it should be sufficient to mention that any convenient known type of detector means may be used. As an example a detector system according to our copending patent application Ser. No. 510,993, filed Oct. 1, 1974, which discloses a photo electric detection of the stop positions of the drums, will be usable without any kind of adaption of the system described hereinbefore.

What we claim is:

1. A slot machine which includes a common shaft, a plurality of rotary drums individually rotatable about said common shaft, an annular row of various signs and symbols provided on each of said drums, a starting mechanism for providing a start rotation of said common shaft, an actuator handle operatively connected with said starting mechanism, means for starting a rotation of the drums in response to an actuation of said starting mechanism by said actuator handle, and means for automatically stopping the respective drums at mutually different periods of time after a start of rotation of the drums, characterized in that said starting mechanism includes means for causing said common shaft to be rotated initially in a first direction of rotation in response to the actuator handle being pulled toward a start position and for imparting to said common shaft a rapid start rotation in a second direction of rotation opposite to the first direction in response to the actuator handle reaching the start position, means are provided for mounting the drums on said common shaft so as to permit the common shaft to be rotatable relative to the drums through at least a fraction of one revolution including a one-way rotation clutch arranged between the common shaft and each respective drum for causing the drums to be rotated by the rapid start rotation of the common shaft and for allowing the respective drums to continue rotation upon the rapid start rotation of the common shaft being stopped, said one-way rotation clutch including a release for rendering the clutch inoperative thereby allowing the relative rotation both ways between the common shaft and the associated drums, in that an annular row of abutments or notches are provided at each of the drums, said means for automatically stopping the respective drums including a pawl means mounted so as to be displaceable from an inoperative position outside of the annular row of abutments or notches to an operative or stop position in engagement with one of the abutments or notches, means are provided for controlling said pawl means so as to maintain a pawl means in engagement with an abutment or notch during the initial rotation of said common shaft in said first direction and to the inoperative position immediately before the rapid start rotation of the common shaft, and in that holding means are associated with the respective drums for enabling a player selected individual arresting of any one of the drums while the remaining drums are rotated, said holding means including means for actuating said release means of the one-way rotation clutch.

2. A slot machine according to claim 1, characterized in that the means for actuating the release mechanism are operatively connected with the means for stopping the rotation of the drum so that the drum is locked against rotation by said stopping means during an actuation of the release mechanism.

3. A slot machine according to claim 1, characterized in that the one-way rotation clutch of each drum further includes a radially protruding clutch actuator arm, means are provided for biasing the clutch actuator arm in one direction so as to render the one-way clutch operative, and means are provided for biasing the clutch actuator arm in an opposite direction so as to render the clutch inoperative in both directions, and that the means for actuating the clutch release mechanism comprise means for biasing the clutch actuator arm in said opposite direction.

4. A slot machine according to claim 3, characterized in that stop lever means are associated with each of said drums, said pawl means being mounted on each of said stop lever means, and in that the means for biasing the clutch actuator arm in said opposite direction include a portion of the stop lever means.

5. A slot machine according to claim 3, characterized in that a spring-loaded stop lever means is associated with each drum for biasing said one-way rotation clutch toward a clutch release position, said pawl means for engaging the abutments or notches of the respective drums being arranged on said stop lever, means are provided for mounting the clutch actuator arm so as to be rotatable with the common shaft during the initial start rotation of the common shaft so as to force said stop lever into a ready-to-start position in which the pawl means are nearly out of engagement with the abutments or notches of the drum while the stop lever still biases the clutch arm towards the clutch release position, in that automatic control means are provided for causing the stop lever to be retracted from an engaged position with both the clutch arm and the abutment or notch of the drum, whereby the clutch arm is allowed to be shifted into a clutch-actuating position and the drum to be left freely rotatable so as to be started in response to the rapid start rotation of the common shaft, and in that the holding means further includes means for preventing the stop lever from being retracted from the engaged position so as to enable the stop lever to remain in stop engagement position with the drum and in a bias engagement with the clutch actuator arm during a return rotation of the clutch actuator arm by the rapid start rotation of the common shaft.

6. A slot machine according to claim 5, characterized in that electromagnetic means are provided for operating said automatic control means.

7. A slot machine according to claim 1, characterized in that electromagnetic means are provided for selectively operating said means for actuating the release mechanism.

8. A slot machine according to claim 1, characterized in that actuator means are provided for normally rendering said release mechanism operative, and that automatic control means are provided for rendering said actuator means inoperative and therewith the one-way rotation clutch operative in response to the actuator handle being pulled to a release position, said holding means being constituted by means for selectively rendering said automatic control means inoperative so as to cause the respective one-way rotation clutch to be inoperative during the rapid start rotation of the common shaft.

9. A slot machine according to claim 1, characterized in that means are provided for detecting a stop position of the respective drums, and means are operatively connected with said detection means for actuating a pay mechanism in response to said detecting means detecting a predetermined stopped position of the respective drums defined by a specific combination of symbols or signs on the drums.

* * * * *